United States Patent [19]

Bland et al.

[11] Patent Number: 4,863,406

[45] Date of Patent: Sep. 5, 1989

[54] MARINE PROPULSION DEVICE WITH TWO PIECE PROPELLER SHAFT ASSEMBLY INCLUDING SPRING CLIP FOR RELEASABLY PREVENTING RELATIVE MOVEMENT BETWEEN PROPELLER SHAFT PIECES

[75] Inventors: Gerald F. Bland, Glenview, Ill.; Michael W. Freitag, Kenosha, Wis.

[73] Assignee: Outboard Marine Corporation, Waukegan, Ill.

[21] Appl. No.: 182,477

[22] Filed: Apr. 15, 1988

[51] Int. Cl.[4] ..... B63H 21/28

[52] U.S. Cl. ..... 440/83

[58] Field of Search ..... 440/83, 75, 86; 403/298, 314, 316, 317, 327, 369, 377

[56] References Cited

U.S. PATENT DOCUMENTS

| | | | |
|---|---|---|---|
| 3,727,574 | 4/1973 | Bagge | 115/34 |
| 3,807,285 | 4/1974 | Phillips | 403/377 |
| 4,302,196 | 11/1981 | Blanchard | 440/75 |
| 4,392,759 | 7/1983 | Cook | 403/317 |
| 4,583,628 | 4/1986 | McCormick | 440/86 |
| 4,630,958 | 12/1986 | McCallister | 403/377 |
| 4,637,802 | 1/1987 | Taguchi, et al. | 440/75 |
| 4,668,198 | 5/1987 | Nakamura | 440/75 |
| 4,689,027 | 8/1987 | Harada et al. | 440/83 |
| 4,749,301 | 6/1988 | Suzuki | 403/327 |

FOREIGN PATENT DOCUMENTS 61174346 8/1986 Japan .

*Primary Examiner*—Sherman D. Basinger
*Assistant Examiner*—Stephen P. Avila
*Attorney, Agent, or Firm*—Michael, Best & Friedrich

[57] ABSTRACT

Disclosed herein is a marine propulsion device comprising a lower unit including a gearcase, a propeller shaft rotatably mounted in the gear case and adapted to support a propeller, a clutch shaft rotatably mounted in the gearcase in co-axial relation to the propeller shaft, a splined female end portion on one of the propeller shaft and the clutch shaft and a splined male end portion on the other of the propeller shaft and the clutch shaft and engaged with the splined female end portion, and a resilient spring clip cooperating with the propeller shaft and the clutch shaft for releasably retaining the propeller shaft and the clutch shaft in predetermined axial relation to each other.

5 Claims, 1 Drawing Sheet

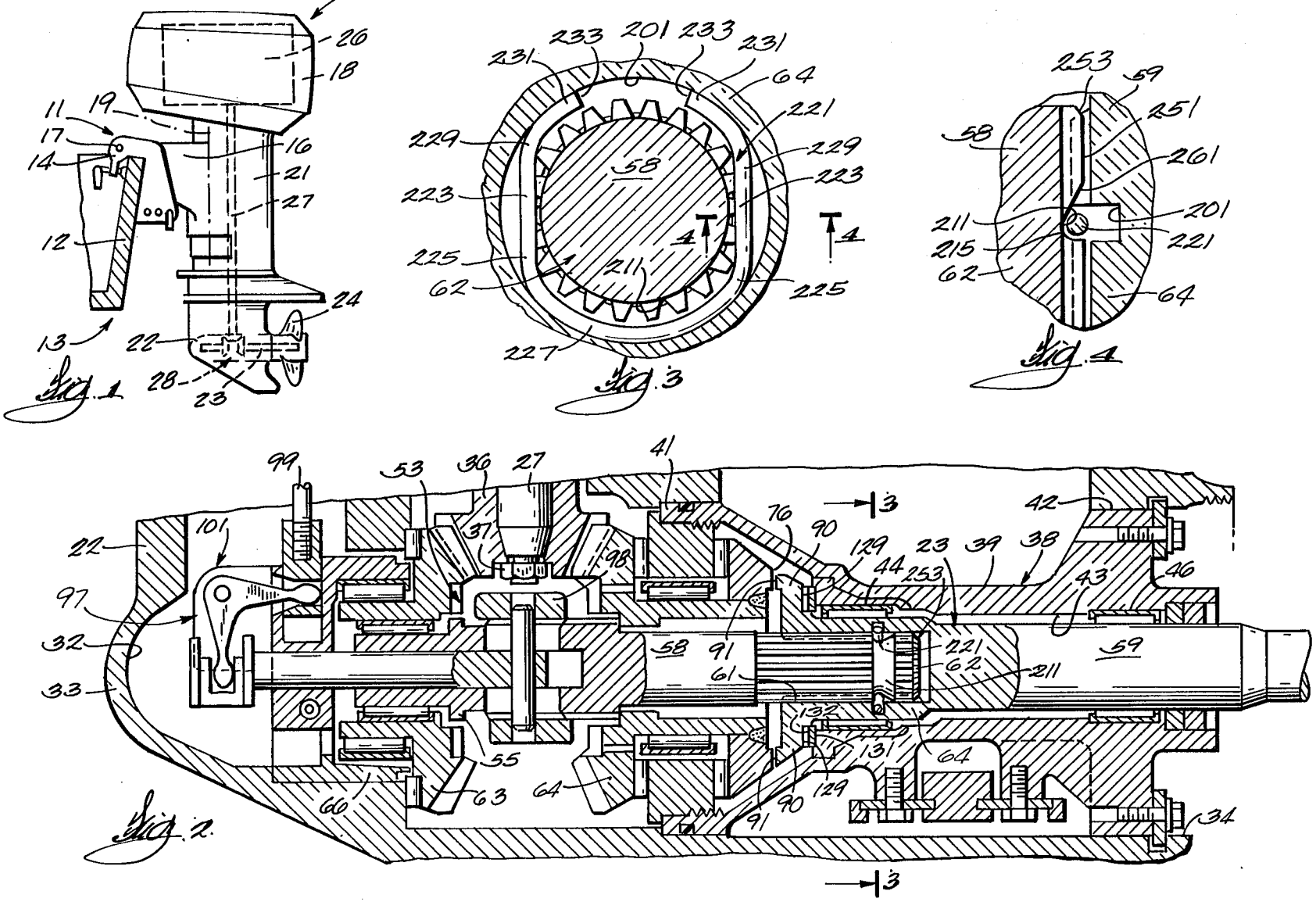

MARINE PROPULSION DEVICE WITH TWO PIECE PROPELLER SHAFT ASSEMBLY INCLUDING SPRING CLIP FOR RELEASABLY PREVENTING RELATIVE MOVEMENT BETWEEN PROPELLER SHAFT PIECES

RELATED APPLICATION

Attention is directed to co-pending application Ser. No. 055,733, filed May 29, 1987 and entitled "Counter-Rotation Transmission".

BACKGROUND OF THE INVENTION

The invention relates to marine propulsion devices and to lower units thereof including reversing transmissions. The invention also relates to such lower units including so called two-piece propeller shafts.

The invention also relates to relative axial movements and locations of the two propeller pieces during assembly and operation.

Attention is also directed to the following U.S. and foreign patent documents:

| | | |
|---|---|---|
| Taguchi, et al. | U.S. No. 4,637,802 | January 20, 1987 |
| Bagge | U.S. No. 3,727,574 | April 17, 1973 |
| Blanchard | U.S. No. 4,302,196 | November 24, 1981 |
| Nakamura, et al. | U.S. No. 4,668,198 | May 26, 1987 |
| Harada, et al. | Japan No. 61-174346 | August 7, 1986 |

SUMMARY OF THE INVENTION

The invention provides a marine propulsion device comprising a lower unit including a gearcase, a propeller shaft rotatably mounted in the gear case and adapted to support a propeller, a clutch shaft rotatably mounted in the gearcase in co-axial relation to the propeller shaft, a splined female end portion on one of the propeller shaft and the clutch shaft and a splined male end portion on the other of the propeller shaft and the clutch shaft and engaged with the splined female end portion, and a resilient spring clip cooperating with the propeller shaft and with the clutch shaft for releasably retaining the propeller shaft and the clutch shaft in predetermined axial relation to each other.

The invention also provides a marine propulsion device comprising a lower unit including a gearcase, a propeller shaft rotatably mounted in the gearcase, adapted to carry a propeller, and including a splined female end portion including an open end and having therein a transversely extending annular groove in adjacently spaced relation to the open end, a clutch shaft rotatably mounted in the gearcase in co-axial relation to the propeller shaft and including a splined male end portion engaged with the splined female end portion, which male end portion includes an exterior surface having a chamfered end, an annular groove spaced inwardly from the chamfered end and having a bottom, and a ramp extending rearwardly from the bottom to the exterior surface, and a spring clip cooperating with the propeller shaft and the clutch shaft for resiliently retaining the propeller shaft and the clutch shaft in predetermined axial relation to each other, which spring clip is generally circular in shape and includes a pair of diametrically spaced flat portions adapted to be respectively received in the annular groove in the male end portion when the clip is in a relatively relaxed condition and adapted to be received in the annular groove in the female end portion when the clip is in a relatively stressed condition, and an arcuate segment connecting the flat portions and adapted to be received in the annular groove in the female end portion.

Other features and advantages of the invention will become apparent to those skilled in the art upon review of the following detailed description, claims and drawings.

DESCRIPTION OF THE DRAWINGS

FIG. 1 is a side elevational view of a marine propulsion device which includes a reversing transmission and which embodies various of the features of the invention.

FIG. 2 is an enlarged cross-sectional view of the reversing transmission included in the marine propulsion device shown in FIG. 1.

FIG. 3 is a fragmentary sectional view taken along line 3—3 of FIG. 2.

FIG. 4 is an enlarged fragmentary sectional view taken along line 4—4 of FIG. 3.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine propulsion device 10 comprises a mounting assembly 11 fixedly attached to the transom 12 of a boat 13. While various suitable mounting assemblies can be employed, in the preferred embodiment, the mounting assembly includes a transom bracket 14 fixedly attached to the transom 12, and a swivel bracket 16 mounted on the transom bracket 14 for pivotal movement of the swivel bracket 16 relative to the transom bracket 14 about a generally horizontal tilt axis 17.

The marine propulsion device 10 also comprises a propulsion unit 18 mounted on the swivel bracket 16 for pivotal movement of the propulsion unit 18 relative to the swivel bracket 16 about a generally vertical steering axis 19. The propulsion unit 18 includes a lower unit 21 having a gearcase housing 22, a rotatable propeller shaft assembly 23 extending from the gearcase housing 22, and a propeller 24 mounted on the propeller shaft assembly 23. An internal combustion engine 26 is mounted on the lower unit 21 and is drivingly connected through the propeller shaft assembly 23 to the propeller 24 by means of a drive shaft 27. A counter-rotation transmission 28 is located within the gearcase housing and is operable to selectively couple the drive shaft 27 to the propeller shaft assembly 23. While the disclosed construction is "counter rotation" the invention is also applicable "standard rotation" construction.

The counter-rotation transmission 28 within the gearcase 22 of the marine propulsion device 10 is illustrated in FIG. 2. As shown, the gearcase housing includes a hollow interior 32 having a closed forward end 33 and an open rearward end 34. One end of the drive shaft 27 extends downwardly into the interior 32 of the gearcase housing 22, and a pinion 36 is mounted on the end of the drive shaft by means of a threaded nut 37.

To rotatably support the propeller shaft assembly 23 within the gearcase housing, the counter-rotation transmission 28 includes a propeller shaft bearing housing assembly 38 positioned within the gearcase housing 22 adjacent the open rear end. The bearing housing assembly 38 includes a propeller shaft bearing housing 39 which is generally cylindrical in form and includes an open, bell-shaped forward end 41 defining an interior or cavity, and a disc-shaped rearward end 42. A substantially circular passageway 43 is formed axially through the propeller shaft bearing housing 39, and forward and rearward bearing assemblies 44 and 46 are provided adjacent the forward and rearward ends 41 and 42 of the propeller shaft bearing housing 39 to rotatably support the propeller shaft assembly 23 within the propeller shaft bearing housing 39. The disc-shaped rearward end 42 of the bearing housing 39 includes a plurality of openings (not shown) permitting rearward passage from the gearcase housing 22 of exhaust gases.

As further illustrated in FIG. 2, the propeller shaft assembly 23 includes a rear propeller shaft or portion or section onto which the propeller 24 is mounted, and a forward clutch shaft or portion or section extending forwardly of the rear propeller shaft or portion. In the embodiment shown, the propeller shaft assembly 23 is of split-shaft configuration and the forward portion or section comprises a forward section or clutch shaft 58, while the rear end portion or section comprises a rearward section or rear propeller shaft 59 positioned rearwardly of, and coaxially aligned with, the clutch shaft 58. The clutch shaft 58 and rear propeller shaft 59 are coupled for co-rotation with each other by means of a splined connection. In this regard, the clutch shaft 58 includes a rearward male splined end portion 62 and the rear propeller shaft 59 includes a forward female splined end portion 64 which receives the male end portion 62 to afford common rotation of the rear propeller shaft 59 with the clutch shaft. If desired, the male portion could be part of the rear propeller shaft 59 and the female portion could be part of the clutch shaft 58.

To selectively translate rotation of the vertical drive shaft 27 into rotation of the rear propeller shaft 59, the counter-rotation transmission 28 further includes a pair of bevel gears 63 and 64 coaxially aligned with the clutch shaft 58 and located, respectively, forwardly and rearwardly of the pinion 36 so as to mesh with opposite sides of the pinion 36. As shown, the forwardly located bevel gear 63 is rotatably supported by means of a forwardly located bevel bearing housing or shifter housing 66 mounted within the gearcase housing 22 adjacent the closed forward end 33. Suitable means, not a part of this invention, are also provided for rotatably supporting the rearwardly located bevel gear 64.

Referring to FIG. 2, means in the form of a reversing transmission are provided for selectively coupling the clutch shaft 58 for co-rotation with one or the other of the bevel gears 63 or 64. While various suitable selective coupling means can be employed, in the illustrated embodiment, the reversing transmission includes a clutch dog 98 adapted for axial sliding movement along the exterior of the clutch shaft 58 between the forwardly located and rearwardly located bevel gears 63 and 64. The clutch dog 98 is non-rotatable relative to the clutch shaft 58 and is adapted to engage and thereafter co-rotate with whichever one of the forward or rearwardly located bevel gears 63 or 64 it is moved toward.

Control over which of the forwardly or rearwardly located bevel gears 63 or 64 is engaged by the clutch dog 98 is provided by means of a shifter mechanism 97 which further includes an elongate shift rod 99 extending downwardly into the gearcase housing 22 adjacent the closed forward end 33.

In operation, upward movement of the shift rod 99 causes counter-clockwise movement of the shift lever 101 as viewed in FIG. 2. As a result, the clutch dog 98 is driven rearwardly into engagement with the rearwardly located bevel gear 64. Similarly, downward movement of the shift rod 99 causes clockwise movement of the shift lever 101 as viewed in FIG. 2, with the further result that the clutch dog 98 is driven forwardly into engagement with the forwardly located bevel gear 63.

When the shifter mechanism 97 is operated such that the clutch dog 98 engages the forwardly located bevel gear 63, propeller shaft rotation is such that reverse thrust is developed by the propeller 24 and transmitted through the rear propeller shaft 59. In order to transmit the reverse thrust thus developed to the gearcase housing 22, the flange 90 formed at the forward end of the rear propeller shaft 59 includes an annular, rearwardly facing, thrust transferring surface 129 which is located opposite an annular, forwardly facing, thrust receiving surface 131 formed in the propeller shaft bearing housing 39 rearwardly of the flange 91. A thrust bearing 132 is disposed between the rearwardly facing thrust transferring surface 129 and the forwardly facing thrust receiving surface 131 and functions to transmit reverse thrust from the rear propeller shaft 59 to the propeller shaft bearing housing 39. From the propeller shaft bearing housing 39, the reverse thrust is transferred through the retaining arrangement 50 to the gearcase housing 22.

When the propeller shaft 23 is coupled for rotation with the rearwardly located bevel gear 64, no relative rotational movement occurs between the forwardly facing thrust transferring surface 91 and the rearwardly facing thrust receiving surface 76. However, during reverse operation, when the propeller shaft 23 is coupled for co-rotation with the forwardly located bevel gear 63, the forwardly facing thrust transferring surface 91 and the rearwardly facing thrust receiving surfaces 76 rotate in opposite directions at a relative rotational rate of twice that of either element alone. In order to avoid excessive wear under such conditions, the rear propeller shaft 59 and the propeller shaft bearing housing assembly 38 are preferably constructed so that some end-play exists between the rear propeller shaft 59 and the forward thrust rear bevel gear assembly 67. Thus, when developing reverse thrust, the rear propeller shaft 59 will move slightly rearwardly to provide a clearance 52 between the surfaces 76 and 91.

Means are also provided for maintaining the clutch shaft 58 and the rear propeller shaft 59 in predetermined axial relation in order to avoid forward displacement of the clutch shaft 58 relative to the rear propeller shaft 59 incident to forward thrust acceleration and thereby to insure maintenance of a clearance 53 between the forward bevel gear 63 and a flange 55 on the clutch shaft 58.

While other constructions can be employed, in the illustrated construction, such means comprises a transversely extending annular groove 201 on the female or socket end portion 64 of the rear propeller shaft 59, preferably located adjacent the forwardly located open end or mouth of the female end portion 64. In addition, such means also includes a transversely extending annular groove 211 on the male end portion 62 of the clutch shaft 58, which annular groove is preferably located near the forward end of the male end portion 62 and includes a bottom 215.

In addition, the means for releasably retaining the clutch shaft 58 and the rear propeller shaft in predetermined axial relation to each other includes a resilient spring clip 221 which can take various forms and which, in the disclosed construction, is generally circular in cross-section, as shown in FIG. 3 and which, when in relatively relaxed condition, includes a pair of diametrically opposite flat or straight portions 223 having corresponding ends 225 which are connected by an arcuate portion 227, and having opposite corresponding ends 229 which are respectively connected to relatively short arcuate portions 231 having respective ends 233 in spaced relation to each other.

The spring clip 221 is initially pre-assembled in the annular groove 201 adjacent the open mouth of the female end portion 64 of the rear propeller shaft 59 by partially collapsing the spring clip 221 and then permitting expansion thereof, when aligned with the annular groove 201, to a relatively relaxed condition. As a consequence of such expansion, the spring clip 221 will be partially located in the annular groove 201 with the flat portions 223 extending, at least in part, out of the annular groove 201 and, in general, in interfering relation to axial insertion of the male end portion 62 of the clutch shaft 58.

Means are provided for facilitating insertion of the male end portion 62 of the clutch shaft 58 into the female end portion 64 of the rear propeller shaft 59 and for permitting axial relative movement therebetween until the annular grooves 201 and 211 are transversely aligned. Such insertion and relative movement is facilitated by releasably radially outwardly displacing the flat portions 223 of the spring clip 221 into the annular groove 201 in the rear propeller shaft 59. While other constructions can be employed, in the disclosed construction, such means is provided by forming the outer end 251 of the male end portion 62 with a chamfer 253 so that initial insertion of the male end portion 62 into the female end portion 64 is effective to cam the flat portions 223 of the spring clip 221 into the annular groove 201 in the rear propeller shaft 59.

When the annular groove 211 of the male end portion 62 is aligned with the annular groove 201 in the female end portion 64, the spring clip 221 will relax with the flat portions 223 moving inwardly and entering into the annular groove 211 in the male end portion 62 of the clutch shaft 58, thereby releasably preventing axial displacement of the rear propeller shaft 59 and the clutch shaft 58 relative to each other.

Means are also provided for facilitating withdrawal of the male end portion 62 from the female end portion 64. While other constructions can be employed, in the disclosed construction, the male end portion 62 is provided with an annular ramp 261 which extends rearwardly from the bottom 215 of the annular groove 211 and gradually inwardly to the outer periphery of the male end portion 62 and which is conical in shape.

As a consequence, when a sufficient withdrawal force is applied to the rear propeller shaft 59, the flat portions 223 of the spring clip 221 will be cammed radially outwardly by the ramps 261 into the annular groove 201 on the rear propeller shaft 59 to locate the spring clip 221 clear of interference with withdrawal of the rear propeller shaft 59 from the clutch shaft 58.

In operation in a counter-rotation gearcase, the spring clip 221 prevents forward travel of the clutch shaft 58, thereby advantageously preventing contact between a flange 55 on the clutch shaft 58 and the bevel gear 63, which clutch shaft 58 and bevel gear 63 are rotating in opposite directions relative to each other at twice the speed of the propeller shaft assembly 23 when the transmission is in forward drive, i.e., when the dog clutch 98 is in engagement with the bevel gear 64. In operation in a standard rotation gearcase, the spring clip prevents 221 rearward travel of the clutch shaft 58, thereby advantageously preventing contact between the clutch shaft 58 and the bevel gear 64, which clutch shaft 58 and bevel gear 64 are rotating in opposite directions relative to each other at twice the speed of rotation of the propeller shaft assembly 23 when the transmission is in forward drive, i.e., when the clutch dog 98 is in engagement with the bevel gear 63.

Various of the features of the invention are set forth in the following claims.

We claim:

1. A marine propulsion device comprising a lower unit including a gearcase, a propeller shaft rotatably mounted in said gearcase and adapted to support a propeller, a clutch shaft rotatably mounted in said gearcase in co-axial relation to said propeller shaft, a splined female end portion located on one of said propeller shaft and said clutch shaft and including a transversely extending groove, and a splined male end portion located on the other of said propeller shaft and said clutch shaft, engaged with said splined female end portion, and including a transversely extending groove, and a resilient spring clip extending in said grooves for releasably retaining said propeller shaft and said clutch shaft in predetermined axial relation to each other.

2. A marine propulsion device comprising a lower unit including a gearcase, a propeller shaft rotatably mounted in said gearcase and adapted to support a propeller, a clutch shaft rotatably mounted in said gearcase in co-axial relation to said propeller shaft, a splined female end portion located on said propeller shaft and including a transversely extending annular groove, a splined male end portion located on said clutch shaft, engaged with said splined female end portion, and including a transversely extending annular groove, and a resilient spring clip extending, in part, in said annular groove in said propeller shaft, and in part, in said annular groove in said clutch shaft for releasably retaining said propeller shaft and said clutch shaft in predetermined axial relation to each other.

3. A marine propulsion device in accordance with claim 2 wherein said male end portion includes an end which has a chamfer for expanding said resilient spring clip so as to enable location of said spring clip wholly in said annular groove in said female end portion in response to insertion of said male end portion into said female end portion.

4. A marine propulsion device comprising a lower unit including a gearcase, a propeller shaft rotatably mounted in said gearcase, adapted to support a propeller, and including a splined female end portion having a transversely extending annular groove, a clutch shaft rotatably mounted in said gearcase in co-axial relation to said propeller shaft and including a male end portion with an outer peripheral surface having therein a transversely extending annular groove with a bottom, said male end portion also including a ramp extending from adjacent said bottom of said annular groove to said exterior surface, and an end which has a chamfer, a resilient spring clip cooperating with said propeller shaft and said clutch shaft for releasably retaining said propeller shaft and said clutch shaft in assembled relation and in predetermined axial relation to each other, said spring clip extending, when said propeller shaft and said clutch shaft are in assembled relation, in part in said annular groove in said propeller shaft, and in part in said annular groove in said clutch shaft, said spring clip engaging said chamfered end, in response to assembly of said propeller shaft and said clutch shaft, to thereby expand said resilient spring clip so as to enable location of said spring clip wholly in said annular groove in said female end portion, and, said spring clip engaging said ramp in response to disassembly of said propeller shaft and said clutch shaft, to thereby enable displacement of said spring clip out of said annular groove in said male end portion and wholly into said annular groove in said female end portion.

5. A marine propulsion device comprising a lower unit including a gearcase, a propeller shaft rotatably mounted in said gearcase, adapted to carry a propeller, and including a splined female end portion including an open end and having therein a transversely extending annular groove in adjacently spaced relation to said open end, a clutch shaft rotatably mounted in said gearcase in co-axial relation to said propeller shaft and including a splined male end portion engaged with said splined female end portion, said male end portion including an exterior surface having a chamfered end, an annular groove spaced inwardly from said chamfered end and having a bottom, and an annular ramp extending rearwardly from said bottom to said exterior surface, and a spring clip cooperating with said propeller shaft and said clutch shaft for resiliently retaining said propeller shaft and said clutch shaft in predetermined axial relation to each other, said spring clip being generally circular in shape and including a pair of diametrically spaced flat portions adapted to be respectively received in said annular groove in said male end portion when said clip is in a relatively relaxed condition and adapted to be received in said annular groove in said female end portion when said clip is in a relatively stressed condition, and an arcuate segment connecting said flat portions and adapted to be received in said annular groove in said female end portion.

* * * * *